US008517759B1

(12) United States Patent
Brown

(10) Patent No.: US 8,517,759 B1
(45) Date of Patent: Aug. 27, 2013

(54) RIBBON FLEX LIGHT CONNECTOR SYSTEM

(75) Inventor: H. Scott Brown, Greensboro, NC (US)

(73) Assignee: Blue Sun Energy, Inc., Greensboro, NC (US)

( * ) Notice: Subject to any disclaimer, the term of this patent is extended or adjusted under 35 U.S.C. 154(b) by 14 days.

(21) Appl. No.: 13/397,438

(22) Filed: Feb. 15, 2012

Related U.S. Application Data

(60) Provisional application No. 61/443,054, filed on Feb. 15, 2011.

(51) Int. Cl.
*H01R 12/24* (2006.01)

(52) U.S. Cl.
USPC ..... 439/492

(58) Field of Classification Search
USPC ..... 439/492, 493, 426, 418; 362/249.03, 362/149, 249.02, 249.04, 249.05, 240; 250/221
See application file for complete search history.

(56) References Cited

U.S. PATENT DOCUMENTS

| | | | | |
|---|---|---|---|---|
| 3,824,529 | A * | 7/1974 | Dorrell | 439/418 |
| 4,173,035 | A * | 10/1979 | Hoyt | 362/249.04 |
| 4,864,081 | A * | 9/1989 | Bates | 174/88 R |
| 4,913,656 | A * | 4/1990 | Gordon et al. | 439/67 |
| 5,051,366 | A * | 9/1991 | Anderson et al. | 436/67 |
| 5,197,902 | A * | 3/1993 | Cesar | 439/492 |
| 5,295,838 | A * | 3/1994 | Walen et al. | 439/67 |
| 5,321,593 | A * | 6/1994 | Moates | 362/249.05 |
| 5,509,812 | A * | 4/1996 | Comerci et al. | 439/76.1 |
| 5,730,619 | A * | 3/1998 | Hamlin | 439/493 |
| 5,947,753 | A * | 9/1999 | Chapman et al. | 439/79 |
| 6,184,469 | B1 * | 2/2001 | Conti | 174/72 TR |
| 6,247,951 | B1 * | 6/2001 | Di Liello et al. | 439/329 |
| 6,299,469 | B1 * | 10/2001 | Glovatsky et al. | 439/329 |
| 6,320,137 | B1 * | 11/2001 | Bonser et al. | 174/255 |
| 6,491,410 | B2 * | 12/2002 | Ladstatter et al. | 362/221 |
| 6,537,082 | B2 * | 3/2003 | Hopfer et al. | 439/67 |
| 6,602,092 | B2 * | 8/2003 | Soubh | 439/493 |
| 6,673,293 | B1 * | 1/2004 | Mistopoulos et al. | 264/149 |
| 6,773,288 | B2 * | 8/2004 | Geltsch et al. | 439/329 |
| 7,034,230 | B2 * | 4/2006 | Fan | 174/117 F |
| 7,309,249 | B2 * | 12/2007 | Pabst et al. | 439/329 |
| 7,341,476 | B2 * | 3/2008 | Soeta | 439/493 |
| 7,411,174 | B2 * | 8/2008 | Eash | 250/221 |
| 7,507,100 | B2 * | 3/2009 | Malkin et al. | 439/329 |
| 7,789,529 | B2 * | 9/2010 | Roberts et al. | 362/249.02 |
| 7,938,661 | B2 * | 5/2011 | Good et al. | 439/271 |
| 8,262,250 | B2 * | 9/2012 | Li et al. | 362/219 |
| 8,408,936 | B2 * | 4/2013 | Lo et al. | 439/426 |
| 2010/0008090 | A1 * | 1/2010 | Li et al. | 362/249.03 |

* cited by examiner

*Primary Examiner* — Alexander Gilman
(74) *Attorney, Agent, or Firm* — James Creighton Wray

(57) ABSTRACT

Push-on friction fit connectors for LED light strips form continuous flexible ribbon light strips. The low voltage light strips are cut at contacts periodically exposed along the strips. Ends of the strips with exposed contacts are pushed into receivers. Bent inward wires make frictionally connect contacts at ends of the strips. Wires extending through edges of the receivers are soldered to exposed contacts on printed circuit boards on which the spaced receivers are mounted. Circuits with contacts on the boards are connected to wires extending from the spaced receivers. Tops and sides of the receivers and bottom edges of the circuit board are protected by two-part outer covers. The covers are bonded or sonically welded to the receivers and the circuit board, leaving only outer ends of the receivers and their openings exposed.

1 Claim, 11 Drawing Sheets

RIBBON FLEX LIGHT CONNECTOR SYSTEM

This application claims the benefit of U.S. Provisional Application No. 61/443,054 filed Feb. 15, 2011, which is hereby incorporated herein by reference in its entirety.

SUMMARY OF THE INVENTION

The invention provides new push-on friction fit connectors for ends of flexible ribbon LED light strips to form a continuous connection of the flexible ribbon light strips. The low voltage flexible light strips are cut at contacts periodically exposed along the strips. The ends of the strips with exposed contacts are pushed into openings in receivers. Wires in the receivers are bent inward in the openings and make friction electrical connections with the contacts at the ends of the strips. The wires extend through inward edges of the receivers and are soldered to exposed contacts on a printed circuit board on which the spaced receivers are mounted. Circuits within or printed on the circuit boards are connected to the spaced contacts on the printed circuit boards that are connected to the wires extending inward from the spaced receivers.

Tops and sides of the receivers and bottom edges of the circuit board are protected by two-part outer covers. The covers are bonded or sonically welded to the receivers and the circuit board, leaving only outer ends of the receivers and their openings exposed.

These and further and other objects and features of the invention are apparent in the disclosure, which include the above and ongoing written specification, with the drawings.

DETAILED DESCRIPTION OF THE DRAWINGS

FIG. 1-25 show examples of push-in connectors for easily and smoothly connecting ends of LED lighting strips.

Figure 1:
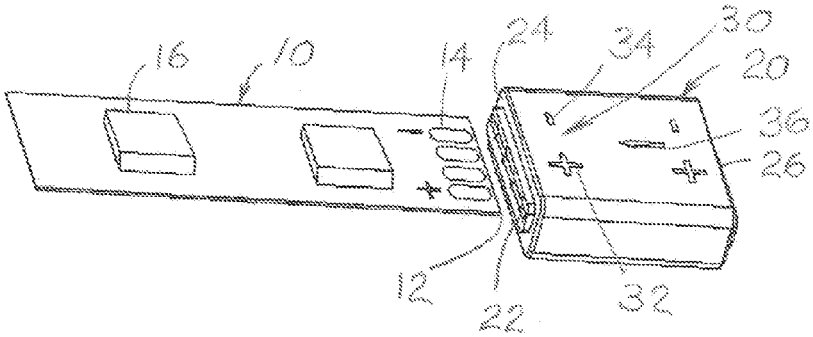
FIG. 1 shows an end-to-end connector for interconnecting two flexible LED lighting strips similar to the one which is being inserted into one end of the connector.

FIG. 1 shows an end-to-end connector 20 for a flexible LED lighting strip which is being inserted into one end of the connector. The end-to-end connector 20 has a square shape with openings 22 at opposite ends 24, 26. Each of the openings receives an end 12 of a flexible LED lighting strip 10. Exposed contacts 14 on the ends 12 are connected to flexible conductors embedded within the strip 10. LED lights 16 along the strip 10 are connected to the embedded conductors.

The connector 20 has positive (+) 32 and negative (−) 34 marks 30 on the connecting ends to ensure correct orientation of the connector 20 and correct insertion of ends 12 of strips 10 in openings 22. An arrow mark 36 on the connector 20 guides insertion directions of the strips and indicates the strip conducting power into and through the connector.

Figure 2:
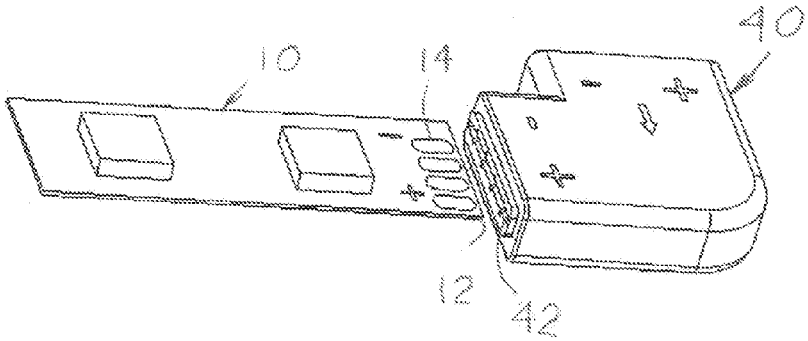
FIG. 2 shows a right angle connector for interconnecting two flexible LED lighting strips.

FIG. 2 shows a right angle 40 connector for connecting two flexible LED lighting strips 10. The right angle connector 40 has openings 42 in angularly related ends 44, 46 for inserting ends 12 with exposed contacts on adjacent perpendicularly oriented strips 10.

Figure 3:
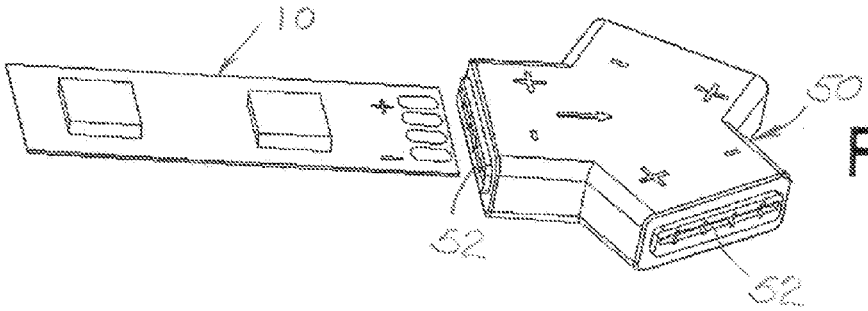
FIG. 3 shows a Y-connector for interconnecting three flexible LED lighting strips together.

FIG. 3 shows a Y-connector 50 for connecting three flexible LED lighting strips 10. Connector 50 has openings 52 in three angularly related ends 54, 56, 58 for contacts 14 on receiving ends 12 of angularly related LED lighting strips 10. Markings 32, 34, 36 show polarities and orientation of connectors and lighting strip contact ends 12.

Figure 4:
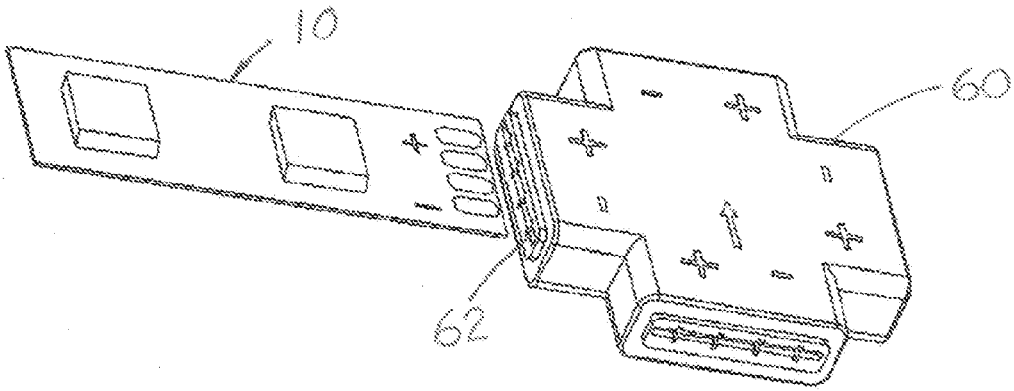
FIG. 4 shows a cross connector perpendicular light strip connector for interconnecting four flexible LED lighting strips in the shape of an X or cross.

FIG. 4 shows an X or cross connector 60 for connecting four flexible LED lighting strips 10. Connector 60 has openings 62 in four angularly related ends 64, 66, 67, 68 for receiving ends 12 and contacts 14 of perpendicularly related LED lighting strips 10. Markings 32, 34, 36 show polarities and orientation of connectors and lighting strip contact ends 12.

Figure 5:
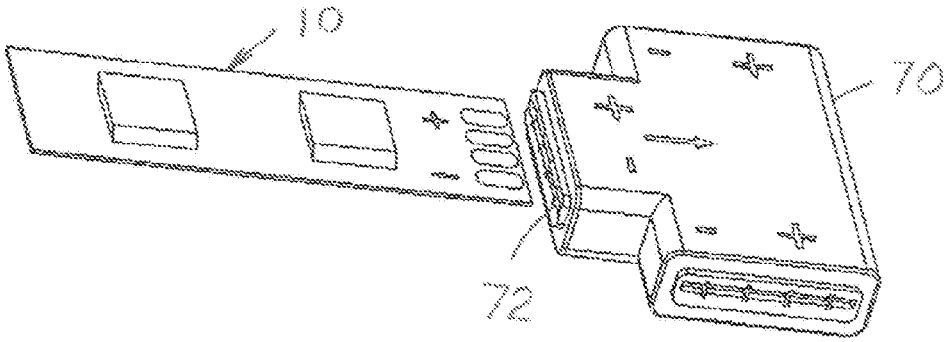
FIG. 5 shows a perpendicular connector for interconnecting three flexible LED lighting strips in which one strip is perpendicular in the form of a T connection.

FIG. 5 shows a T or perpendicular connector 70 for connecting three flexible LED lighting strips 10. Connector 70 has openings 72 in three angularly related ends 74, 76, 78 for receiving contacts 14 on ends 12 of angularly related LED lighting strips 10. Markings 32, 34, 36 show polarities and orientation of connectors and lighting strip contact ends 12.

As shown in FIGS. 6-25 each connector 20, 40, 50, 60, 70 has basic elements, a body 80 made of receivers 81, a printed circuit board base 83 with embedded printed circuits, mounting pads 82 on the printed circuit base, and a two-part cover 84 that covers and holds the elements, leaving exposed only openings 22, 42, 52, 62, 72 in the receivers 81.

Figure 8:
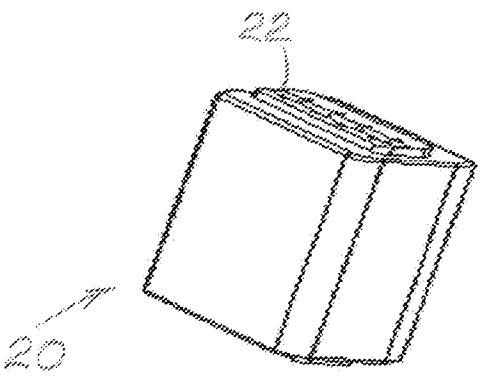
FIGS. 6-9 show parts, assembly and circuit board connectors of an end-to-end connector shown in FIG. 1.
Figure 7:
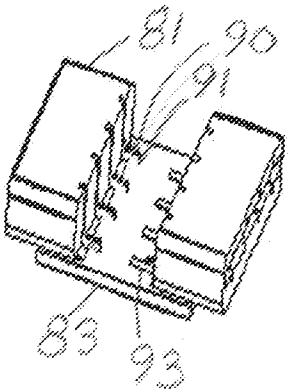
Figure 6:
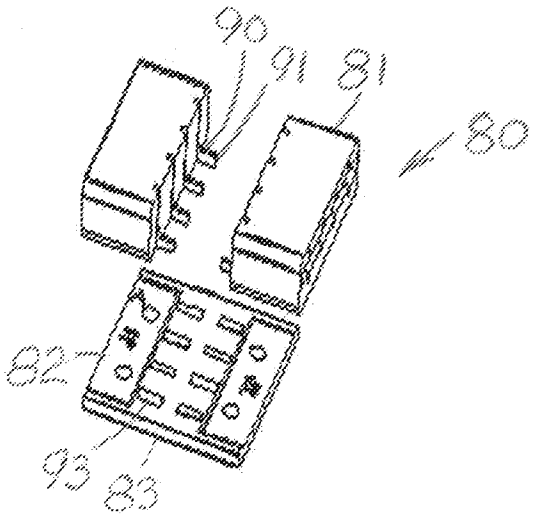

As shown in FIGS. 6-10 in connector 20, the body 80 has two receivers 81 for securing on two mounting pads 82 mounted oppositely on a square circuit board base 83. As shown in FIG. 7 ends 91 of wires 90 extend from receivers 81 and are soldered to contacts 93 on the circuit board base 83. Inward bent loops or inward bent opposite ends of wires 90 within the receivers openings 22 frictionally engage exposed contacts 14 on ends 12 of the flexible lighting strips 10 when they are inserted in the openings 22 in receivers 81. Two-part covers 84 are bonded or sonically welded to the tops and outer sides of the receivers 81 and to the bottom of circuit board base 83, leaving only the ends and openings 22 of receivers 81 exposed, as shown in FIG. 8.

Figure 9:
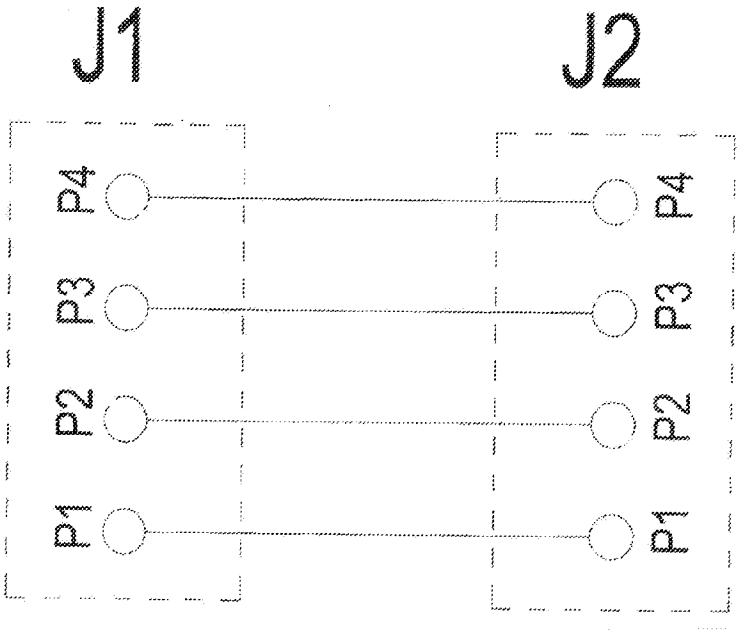

As shown in FIG. 9, the circuit board 83 used in connector 20 has two terminals J1 and J2 and embedded conductors 101, 102, 103, and 104, which respectively connect poles P1, P2, P3 and P4 in junctions J1 and J2. Poles P1, P2, P3 and P4 are connected to the contacts 93 on the circuit board. The contacts 93 form the junctions J1, J2 as shown.

Figure 11:
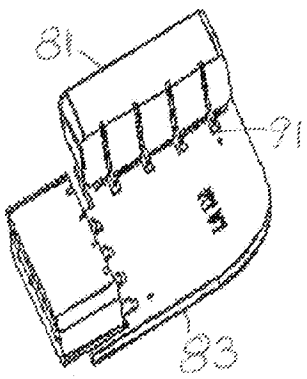
FIGS. 10-13 show parts, assembly and circuit board connections of a right angle connector shown in FIG. 2.
Figure 10:
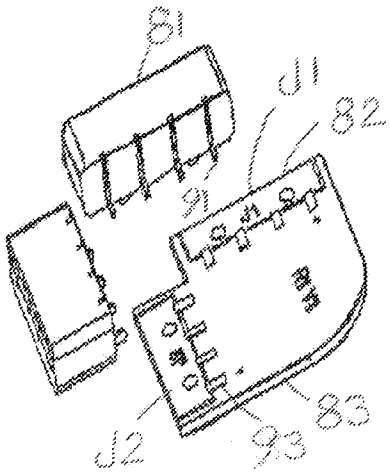
Figure 12:
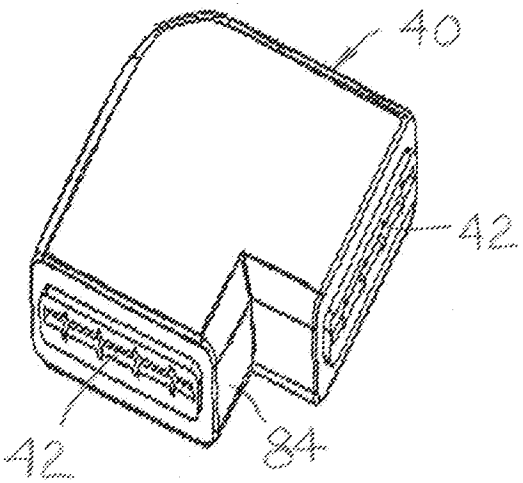

FIGS. 10-13 show parts and connections of a right angle connector 40, as shown in FIG. 2. A rounded circuit board base 83 has two mounting pads 82 and four exposed contacts 93 at each end of conductors that are buried in or exposed on the lower side of the circuit board base 83, as shown in FIG. 10. Two receivers 81 are mounted on pads 82, as shown in FIG. 11. The receivers, board and contacts are covered with two-part covers 84, which are bonded or sonically welded together, leaving only ends and openings 42 of receivers 81 exposed, as shown in FIG. 12.

Figure 13:
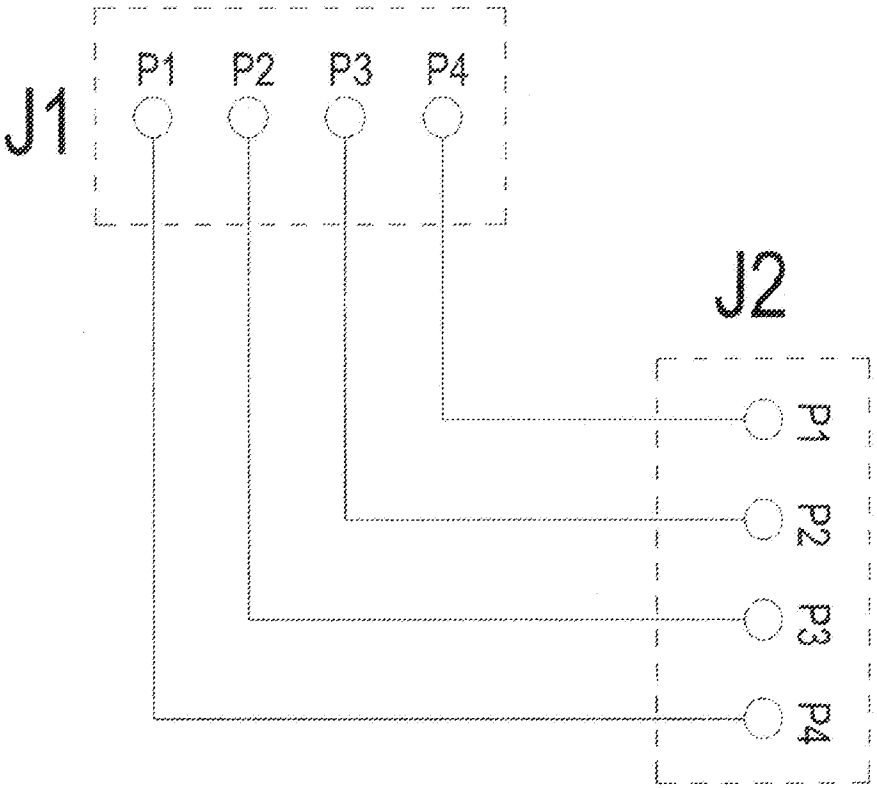

FIG. 13 shows the terminals J1 and J2 and printed circuits 101, 102, 103, 104, which respectively connect poles P1, P2, P3 and P4 in the junctions J1 and J2 and the contacts 93 along adjacent side edges of the circuit board 82.

FIGS. 14-17 show parts, assembly and circuit board connections of a Y-connector shown in FIG. 3.

Figure 15:
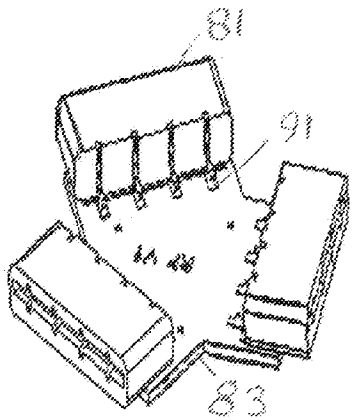
Figure 14:
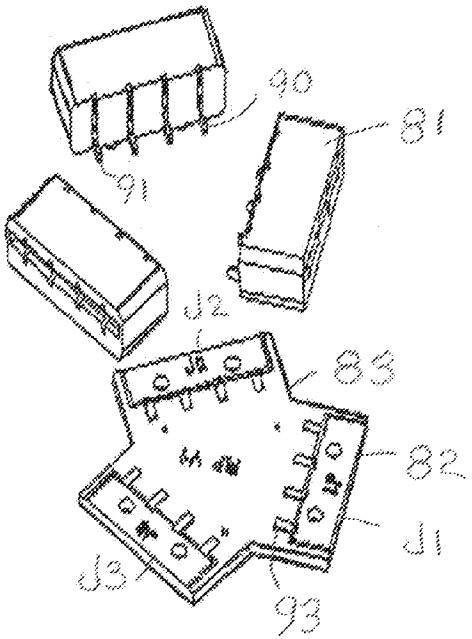

FIG. 14 shows the printed circuit board 83, the contact pads 82 and the receivers 81 of a Y-connector 50 as shown in FIG. 3. FIG. 15 shows the receivers 81 mounted on the pads 82, with ends 91 of wires 90 extending inward from the receivers 81 soldered to the contacts 93 on the circuit board 83.

Figure 16:
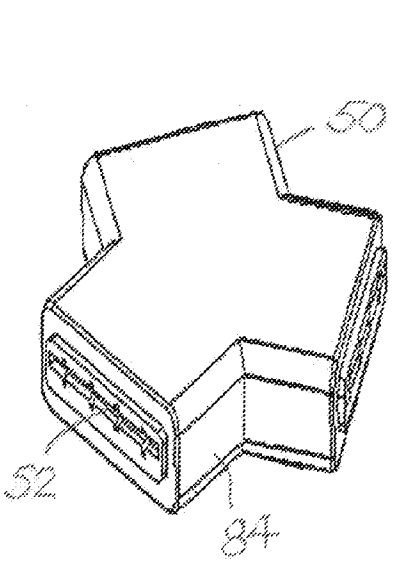
FIGS. 14-17 show parts, assembly and circuit board connections of a Y-connector shown in FIG. 3.
Figure 17:
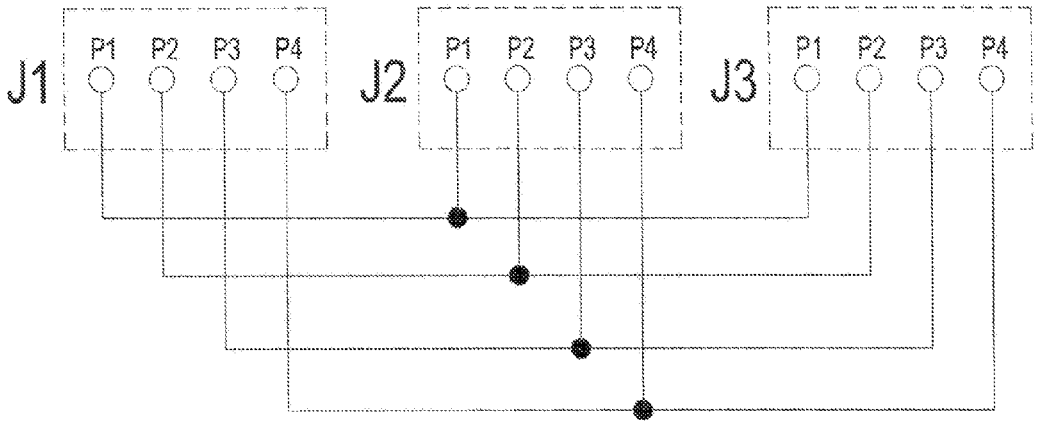

FIG. 16 shows the two-part cover 84 bonded or sonically welded on tops and sides of the receivers 81 and the bottom of the circuit board 83, leaving exposed only the ends with the openings 52 of the receivers 81. FIG. 17 shows the printed conductors 101, 102, 103, 104 in the circuit board and their three junctions J1, J2, J3, each having four poles P1, P2, P3, P4 that are connected to respective contacts 93 on the circuit board 83.

Figure 18:
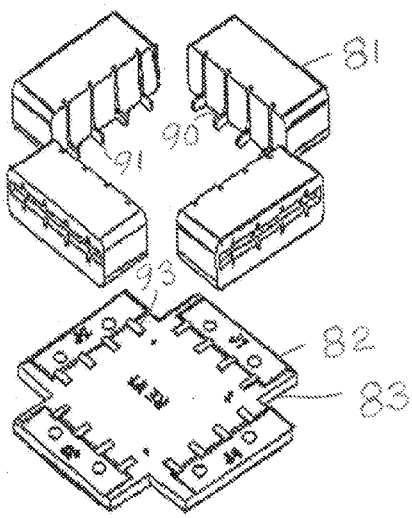
FIGS. 18-21 show parts, assembly and circuit board connections of a four strip connector shown in FIG. 4.
Figure 19:
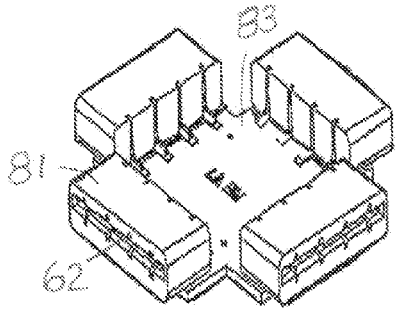
Figure 20:
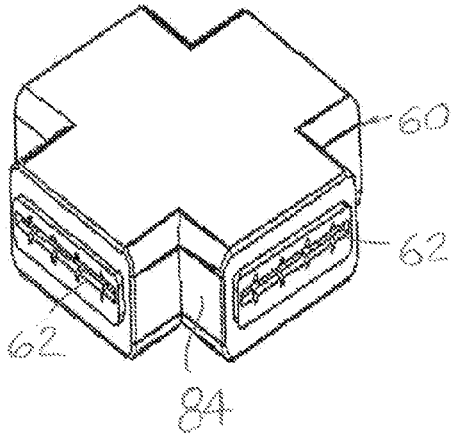
Figure 21:
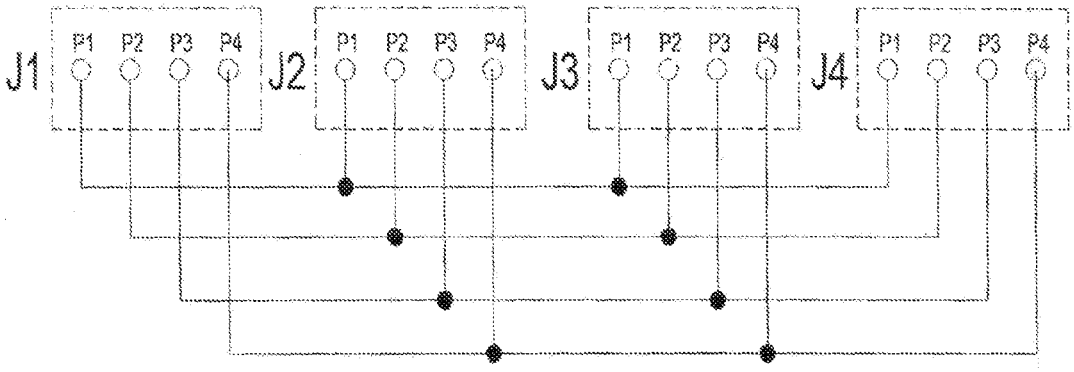

FIGS. 18-21 show parts, assembly and circuit board connections of a four strip X or cross connector 60 shown in FIG. 4. FIG. 18 shows the printed circuit board 83 the pads 82 and the receivers 81 of the four strip perpendicular X connector 60 shown in FIG. 4. FIG. 19 shows the receivers 81 mounted on the pads 82 with ends 91 of wires 90 extending inward from the receivers soldered to the contacts 93 on the circuit board 83. FIG. 20 shows the two-part covers 84 bonded or sonically welded on tops and sides of the receivers 81 and on the bottom of the circuit board 83, leaving exposed only the ends with the strip push-in openings 62 of the receivers 81. FIG. 21 shows the connections between the conductors 101, 102, 103, 104 in the circuit board and their four junctions J1, J2, J3, J4, each having four poles P1, P2, P3, P4 connected to the contacts 93 on the circuit boards 83.

Figure 23:
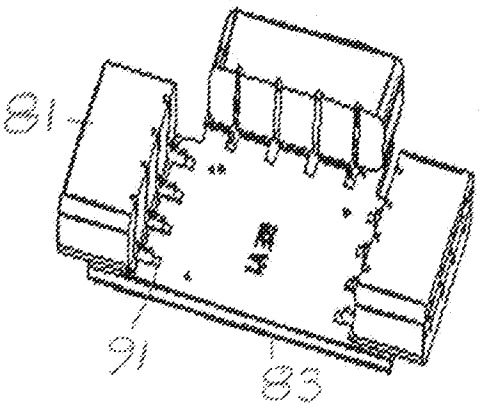
FIGS. 22-25 show parts, assembly and circuit board connections of a perpendicular T connector shown in FIG. 5.
Figure 22:
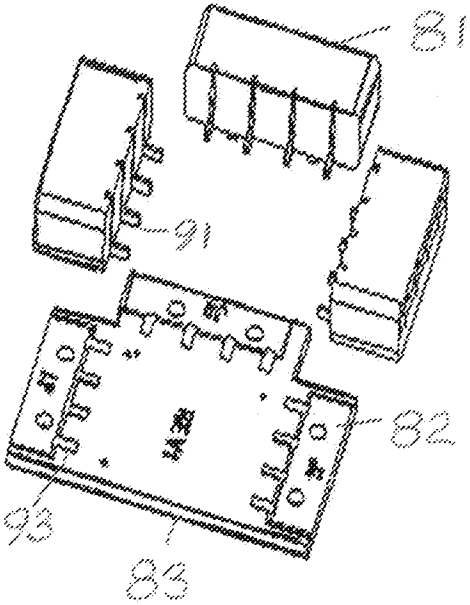

FIGS. 22-25 show parts, assembly and circuit board connections of a perpendicular T connector 70 shown in FIG. 5. FIG. 22 shows the printed circuit board 83, the contact pads 82 and the receivers 81 of the T perpendicular lighting strip joining connector 70. FIG. 23 shows the receivers 81 mounted on the pads 82 with ends 91 of wires 90 extending inward from the receivers 81 soldered to the contacts 93 on the circuit board 83.

Figure 24:
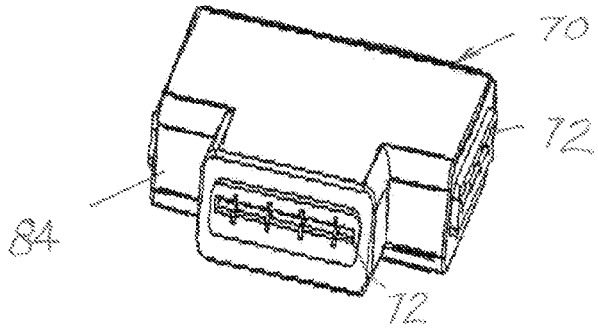
Figure 25:
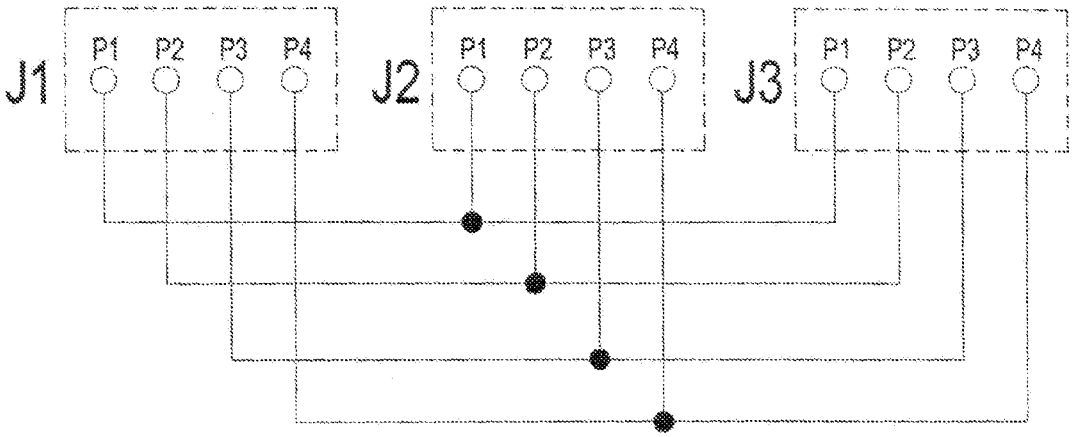

FIG. 24 shows the two-part covers 84 bonded or sonically welded on tops and sides of the receivers 81 and the bottom of the circuit board 83, leaving only the ends with the openings 72 of the receivers 81 exposed. FIG. 25 shows the printed conductors 101, 102, 103, 104 in the circuit board and their three junctions J1, J2, J3, each having four poles P1, P2, P3, P4 that are connected to respective contacts 93 on the circuit board 83.

When the connectors are positioned at corners of three dimensional objects or spaces, the circuit boards 83 and covers 84 may be formed with three dimensional bends so that the receivers 81 extend in angularly related planes.

Figure 26:
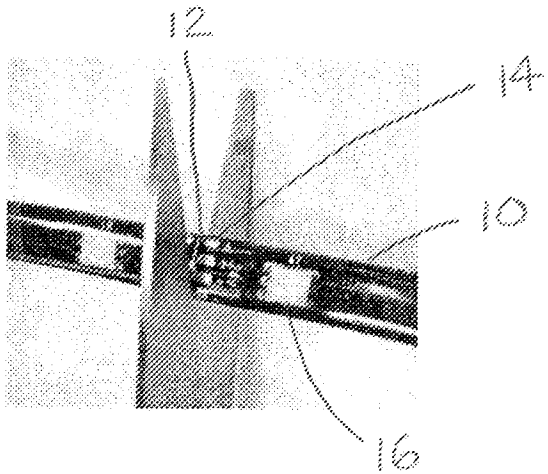
FIG. 26 shows cutting a flexible LED lighting strip through the enlarged exposed contacts to provide contacts at both separated ends of the divided light strips.

FIG. 26 shows cutting a flexible LED lighting strip 10 through the enlarged exposed contacts 14 to provide contacts at both separated ends 12 of the divided light strip.

Figure 27:
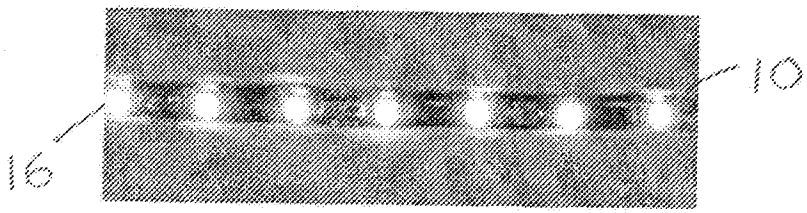
FIG. 27 shows a four wire flexible LED (light emitting diode) lighting strip.

FIG. 27 shows a four printed wire flexible LED (light emitting diode) lighting strip 10 with LEDs 16.

While the invention has been described with reference to specific embodiments, modifications and variations of the invention may be constructed without departing from the scope of the invention.

I claim:

1. A connector apparatus comprising a plurality of flexible ribbon LED light strips, wherein a first light is connected to a second light by a push-on connector to form a continuous connection of flexible ribbon lights, wherein the light strips are cut at contacts to expose wires along the strips, wherein the ends of the strips with the wires of the exposed contacts are pushed into openings in receivers, wherein the wires in the receivers are bent inward in the openings and form an electrical connection with the contacts at the ends of the strips, wherein the wires extend through inward edges of the receivers and are soldered to exposed contacts on a printed circuit board on which the spaced receivers are mounted, wherein circuits within or printed on the circuit board are connected to the spaced contacts on the printed circuit boards that are connected to the wires extending inward from the spaced receivers, wherein tops and sides of the receivers and bottom edges of the circuit board are protected by two-part outer covers, and wherein the covers are bonded or sonically welded to the receivers and the circuit board, leaving only outer ends of the receivers and their openings exposed.

* * * * *